US005771697A

United States Patent [19]

Germain et al.

[11] Patent Number: 5,771,697

[45] Date of Patent: Jun. 30, 1998

[54] STERILIZABLE INSTALLATION FOR PROVIDING A DOSE OF A CRYOGENIC LIQUID

[75] Inventors: Jean-Pierre Germain, Montigny; Boris Gammal, Meudon, both of France

[73] Assignee: L'Air Liquide, Societe Anonyme Pour L'Etude et L'Exploitation des Procedes Georges Claude, Paris, France

[21] Appl. No.: 627,550

[22] Filed: Apr. 4, 1996

[30] Foreign Application Priority Data

Aug. 24, 1995 [FR] France ..... 95 10052

[51] Int. Cl.[6] ..... F17C 7/02

[52] U.S. Cl. ..... 62/50.1; 62/45.1

[58] Field of Search ..... 62/50.1, 45.1

[56] References Cited

U.S. PATENT DOCUMENTS 4,620,962 11/1986 Brodbeck .
5,165,246 11/1992 Cipolla et al. .
5,400,601 3/1995 Germain et al. .
5,557,924 9/1996 Blanton et al. ..... 62/50.1

FOREIGN PATENT DOCUMENTS 591017 3/1994 European Pat. Off. .
1587769 3/1970 France .

*Primary Examiner*—Ronald C. Capossela
*Attorney, Agent, or Firm*—Burns, Doane, Swecker & Mathis, LLP

[57] ABSTRACT

A sterilizable installation for supplying at least one dose of a cryogenic liquid to a use station, wherein said installation comprises, along a fluid transfer line;

a source of a first cryogenic liquid;

a reservoir, suitable for temporary storage of the first cryogenic liquid, comprising a plural number of parts which are assembled using welds executed according to welding techniques that produce total penetration with no lap between two welded parts, such that the reservoir does not include rough spots or other sites of bacterial contamination and providing resistance to temperature fluctuations; and means for withdrawing, in continuous or discontinuous fashion, the first liquid from the reservoir to supply the use station.

18 Claims, 4 Drawing Sheets

STERILIZABLE INSTALLATION FOR PROVIDING A DOSE OF A CRYOGENIC LIQUID

BACKGROUND OF THE INVENTION

I. Field of the Invention

The present invention relates to the field of processes and devices for the delivery or distribution of doses of a cryogenic liquid (for example, liquid nitrogen).

II. Description of Related Art

The invention is applicable to the various industrial fields where it is necessary to deliver doses of a cryogenic liquid, either continuously or in a discontinuous manner, at a rapid or slow pace. The particularly relevant fields include the food products and pharmaceutical fields.

Considering the example of the food products industry, requirements exist here for pressurizing packages or containers ("pressurization") and/or lowering the residual oxygen content over the contained product ("inertization") through the vaporization of liquid nitrogen. This is the case, for example, for metallic boxes or plastic bottles used for the packaging of drinks, where vaporized nitrogen is used both to inertize the gas phase over the filled liquid (thus prolonging the product's storage life) and to prevent crushing of the container.

A particularly difficult problem is the injection of equal doses of cryogenic liquid into containers or packages moving on a conveyor, typically at a very rapid pace which may reach several thousands, and even tens of thousands, of containers or packages per hour. For example, it is important—in order that the internal pressure not vary from one container to the next—that each container receive an equal dose of cryogenic liquid as precisely as possible. Underpressurized or overpressurized containers can be deformed easily, either when they are handled, and in particular when they are stacked, or because of the prevailing internal pressure in the containers.

The applicant has conducted numerous studies on this subject, particularly with the goal of improving devices that supply continuous flows of liquid nitrogen to a use station, or that sequentially supply doses of cryogenic liquid to a use station.

Reference is made in particular to studies such as those reported in the following documents: FR-A-2,547,017; FR-A-2,688,469; FR-A-2,696,152; and FR-A-2,713,216.

These devices typically comprise:

- a source of the cryogenic liquid to be delivered;
- a reservoir, suitable for temporarily storing this cryogenic liquid; and
- means for withdrawing, continuously or discontinuously, the liquid from the reservoir, for supply to the use station.

On the other hand, increasingly severe hygiene and sanitation restrictions have developed for applications in the food products and pharmaceutical fields, leading to increasingly restrictive specifications on contaminants, particulates, and bacteria. Thus, there have been proposals to carry out sterilizing filtrations of the liquid nitrogen in order to satisfy these requirements. The use of filters with pore sizes smaller than 0.2 micron, which are capable of stopping microorganisms with a minimum size of 0.3 micron, has been suggested (a retention capacity which conforms, for example, to the recommendations of the U.S. Food and Drug Administration). However, the use of filters having such a small pore size poses technical problems to the degree that the filter produces a very substantial head loss in the flow, and thus vaporization of liquid nitrogen, and thereby substantially reduces the amount of liquid phase present at the outlet of the sterilizing filter.

SUMMARY AND OBJECTS OF THE INVENTION

One object of the present invention is to be able to supply a use station with doses of sterile cryogenic liquid, either continuously or sequentially.

It is therefore necessary:

- to be able to effectively sterilize a cryogenic liquid, while producing a minimum loss of liquid, but also
- to design an installation that is capable of delivering sterile doses, and thus is itself capable of being sterilized.

The studies which the applicant has carried out on this subject have demonstrated that from the standpoint of sterilization the reservoir that stores the cryogenic liquid represents an extremely critical point in the installation, which is not readily compatible with the sterilization operation traditionally recommended by the pharmacopoeia, such as using a hot fluid, for example, a hot gas (e.g., steam) with recommendations of sets of conditions (temperature, time) to be followed (for example, 121° C./15 minutes).

Thus, for example, the interior of these cryogenic reservoirs presents a relatively irregular surface, with welded joints or other points of reinforcement, which not only represent ideal sites for trapping bacteria, but also points of low resistance to the thermal cycling which the reservoir must withstand: very low temperatures during the storage phases (for example −196° C. in the case of liquid nitrogen), with transition to a high temperature during hot-gas sterilization (for example +121° C.).

The present invention proposes a technical solution to this complex problem in the form of a sterilizable installation for supplying a dose of a cryogenic liquid to a use station, comprising along the line of fluid transfer:

- a source of a first cryogenic liquid;
- a reservoir suitable for temporarily storing the first cryogenic liquid; and
- means for withdrawing, in continuous or discontinuous fashion, the first liquid from the reservoir, for supply to the use station,
- characterized in that the reservoir comprises an outer wall and an inner wall which in particular comprises a plural number of parts assembled by welding, wherein all the corresponding welds are executed according to welding techniques that achieve a total penetration without lap between two welded parts.

As may be understood from reading the preceding, such welds can, depending on the case, occur at potentially broadly diverse locations on the inner wall, for example, between the barrel and the upper and lower heads when the reservoir is composed of three principal parts (a barrel and the heads), or at the point of connection between the inner wall and the means for feeding and withdrawing cryogenic liquid to and from the inner enclosure, or also at connection points between the inner wall and the outer wall.

The studies carried out by the applicant have been able to demonstrate that the use of such welds on the inner wall of the cryogenic reservoir provide for the elaboration of surface states sufficiently good to avoid the creation of rough spots or other sites for bacterial sequestration, while at the same time also providing surfaces which exhibit an excellent resistance to the temperature fluctuations imposed on this technology (storage/sterilization).

As illustrated later in the examples, such a configuration offers excellent results in terms of bacteriological analysis for the cryogenic liquid thus delivered.

Such welds can be obtained, for example, by the "edge fusion" welding technique or the "full-section" welding technique (which the handbooks also call "butt welding"), techniques which are quite well known by welders and which will be illustrated later in the examples. Reference is also made to the following works and publications: volume 2 of the "Welding Handbook" published by the American Welding Society, 8th edition, 1991, or the work "La Sounder à l'Arc Electrique [Electric Arc Welding]" published by the Office Technique Pour l'Utilization de l'Acier [Technical Office for Steel Utilization] in 1933, or the work "p procedure Handbook of Arc Welding Design and Practice" published by the Lincoln Electric Company of Cleveland in 1942.

The term "dose" according to the invention means a quantity of cryogenic liquid supplied to the use station, either continuously or sequentially depending on the particular circumstances.

Depending on the source of cryogenic liquid being used, a filtration module which includes the following may be advantageously installed along the fluid line between the source and the reservoir:

- a bacteriological filter adapted for supply by the source of the first cryogenic liquid;
- an enclosure capable of containing a bath of a second cryogenic liquid (advantageously the same as the first cryogenic liquid to be delivered) wherein the enclosure is dimensioned so as to be able to accept the filter in immersed position; and
- a recondensation coil that is placed between the source of the first cryogenic liquid to be delivered and the filter inlet and can be immersed in the bath of the second cryogenic liquid.

The installation according to the invention will preferably comprise not only this recondensation coil positioned upstream from the filter, but also a second recondensation coil positioned downstream from the filter and also capable of immersion in the bath of the second cryogenic liquid. Even more preferably, the installation will comprise—in addition to these two recondensation coils—a means for creating a head loss that is situated downstream from the filter and is also capable of immersion in the bath of the second cryogenic liquid, wherein the second recondensation coil is positioned between the filter and the said means for creating the head loss.

This means for creating a head loss advantageously consists of a capillary tube.

As will be clearly apparent to the practitioner skilled in the art, the level of the first cryogenic liquid in the reservoir decreases as doses of the liquid are delivered to the use station. In one embodiment of the installation according to the invention, the invention comprises means for regulating the level of the first cryogenic liquid in the reservoir, advantageously comprising means for weighing the reservoir or else strain gages, as well as means that provides for a readjustment of the level of the first cryogenic liquid in the reservoir as a function of the result of the weighing performed by the weighing means or the values registered by the strain gages.

According to another embodiment of the invention, the use station is a station of the type through which containers or packages (such as packages for food products) circulate so as to receive a dose of the first cryogenic liquid, the installation thus including means for regulating the flow of the first cryogenic liquid delivered to the use station, wherein the said regulation is effected based on at least one of the following data:

- the container movement rate at the use station, or else
- a pressure measurement carried out in the gaseous headspace of the cryogenic reservoir.

Other characteristics and advantages of the present invention will become apparent from the following description of embodiments, provided for purposes of illustration but in no way limiting, with reference to the attached drawings, in which:

DETAILED DESCRIPTION OF PREFERRED EMBODIMENTS

Figure 1:
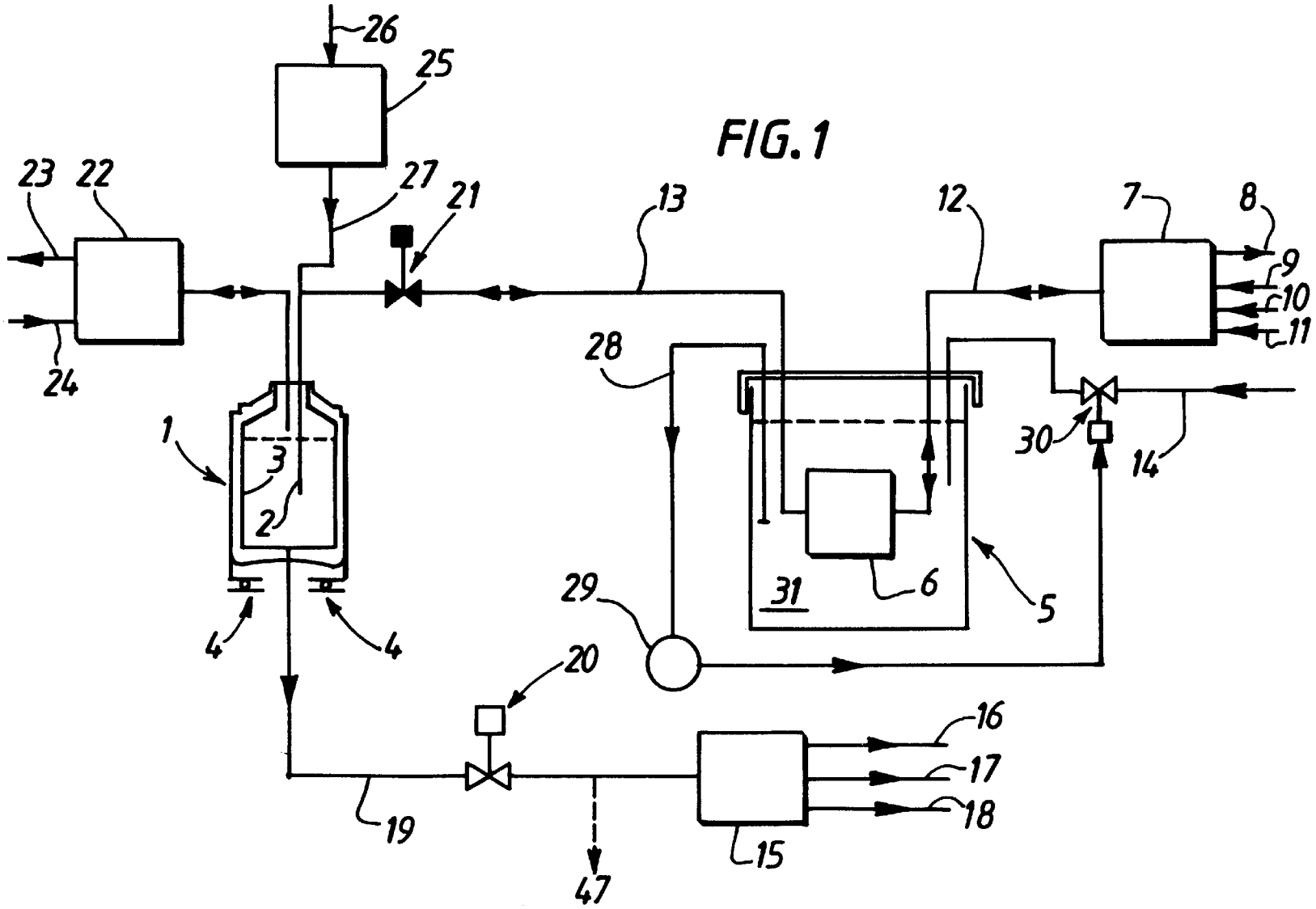
FIG. 1 is a schematic representation of an installation in conformity with the present invention.

FIG. 1 provides a schematic representation of an installation in conformity with the invention including a cryogenic reservoir 1, a filtration module 5, and a plural number of fluid-distribution panels (7, 25, 22, 15) for the installation.

More precisely, panel 7 causes the first cryogenic liquid (for example, liquid nitrogen) from a source 11 to pass via a vacuum cryogenic liquid transfer line 12 and arrive at filtration module 5, which will be described in detail below with reference to FIGS. 2 and 3. There the liquid nitrogen encounters, in immersed position in a bath 31 of a second cryogenic liquid (here the same liquid as that from the source 11), an assembly 6 including a bacteriological filter, one or more recondensation coils, and optionally a means for creating a head loss, before leaving via a vacuum fluid line 13 to reach an isolation valve 21.

It will be noted in this figure that the bath 31 is regularly supplied with cryogenic liquid via a fluid line 14, as a function of the operation of a bath 31 level control (28, 29) which feedbacks to a valve 30 for admission of cryogenic liquid into the enclosure of module 5.

Downstream from the isolation valve 21, the (filtered) cryogenic liquid from filtration module 5 reaches a cryogenic storage reservoir 1, whose inner wall is designated by reference number 3.

Cryogenic liquid is regularly withdrawn from the reservoir 1, as required by a use station 47, via the fluid line 19. The flow of withdrawn cryogenic liquid which reaches the use station 47 is regulated by a control valve 20, for example, as a function of the container movement rate at the use station 47.

Besides the functions already indicated for the panel 7, the four fluid panels 7, 25, 22, and 15 fulfill, for example, the following additional functions, which are related in particular to the sterilization operations to be run on all or part of the installation, at more or less regular intervals, according to the circumstances for the particular user:

panel 7, besides delivery of cryogenic liquid from the source 11, for example, provides for pumping out all or part of the installation via pumping means 8, the admission into the installation of steam or some other hot fluid for sterilization of all or part of the installation (line 9), or sweeping all or part of the installation with a filtered gas such as nitrogen (line 10);

these operations can be carried out from panel 7 on only module 5 (while isolating the rest of the line using the device 21), or can be performed on the entire installation;

panel 15 provides, for example, for pumping out all or part (for example, the reservoir alone,) of the installation (means 16), eliminating the condensate formed during a possible steam sterilization operation (line 17), or evacuating residues of cryogenic liquid in the installation prior to a sterilization operation (line 18);

panel 25 provides, for example, for injecting steam (or other hot fluid) through line 26 into the installation, for example, into the portion situated downstream from the isolation valve 21 and including the cryogenic reservoir 1 and the control device 20;

panel 22 provides, for example, for blowing a filtered sweep gas such as nitrogen into all or part of the installation (line 24), or else through line 23 provides for opening to the atmosphere or else measurement of the pressure in the gaseous headspace of reservoir 1.

A sterilization operation (for example, with steam) of an installation such as that in FIG. 1 could then typically include the following operations:

evacuation of residual liquid nitrogen remaining in the installation by blowing in gaseous nitrogen through panels 22 and/or 7 (depending on which portions of the installation are to be evacuated and sterilized);

pumping out all or part of the installation via panels 15 and/or 7;

steam sterilization at a given temperature and for a prescribed time (for example, in conformity with the Pharmacopoeia), via panels 25 and/or 7 depending on which portion of the installation is to be sterilized; and pumping out under vacuum all or part of the installation to effect drying, via panels 15 and/or 7—this operation of pumping under vacuum can be replaced by sweeping with a dry filtered gas such as nitrogen.

As will be clearly apparent to the practitioner skilled in the art, one could perform several successive sequences including pumping/steam sterilization.

The isolation valve 21 is steam sterilizable, for example, is a pneumatic valve, adapted for operation in vacuum fluid transfer lines, wherein its opening is, for example, controlled as a function of the fill level in the cryogenic reservoir (thus, for example, as a function of the result of weighing the cryogenic reservoir 1 via the means 4).

The control device 20 is also steam sterilizable and has a variable aperture that provides for regulation of the flow of cryogenic liquid withdrawn from the reservoir 1 and destined for the use station 47, for example, as a function of the container movement rate at point 47 or as a function of a pressure measurement in the gaseous headspace of this same reservoir 1 (measurement, for example, performed at panel 22). For reasons of simplicity FIG. 1 does not show the means (computer or programmable robot) whereby the value for the container movement rate at point 47 or the pressure measurement value is fed back to device 20 in support of variation of the delivered flow.

Figure 2:
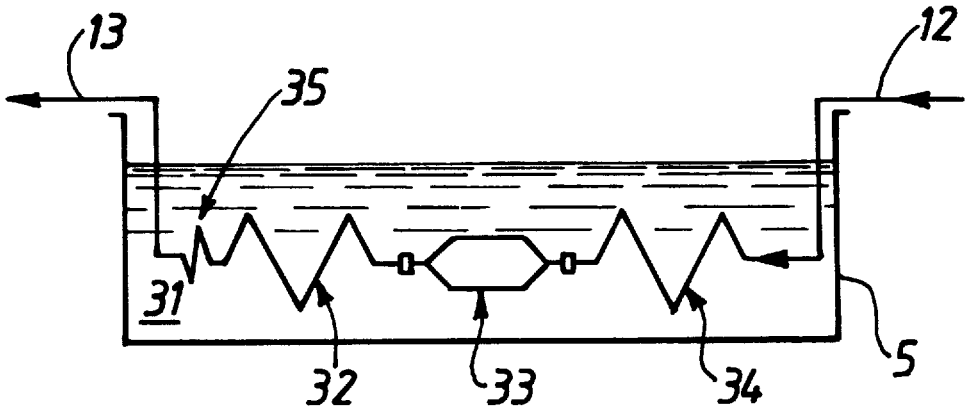
FIG. 2 is a schematic representation of a filtration module in conformity with the present invention.

FIG. 2 illustrates one embodiment of the sterilization module 5, where the cryogenic liquid arriving through fluid line 12 successively encounters a recondensation coil 34, a filter 33 (with a pore size typically less than or equal to 0.2 micrometer, for example, a fitted alumina ceramic filter as proposed by the US Filters company), a second recondensation coil 32, and then a capillary tube 35 which emerges to the exterior of the enclosure by way of fluid line 13.

Immersion of the filter in the cryogenic liquid secures heat exchange between this liquid and the cryogenic liquid which passes through the filter, which considerably reduces vaporization of the liquid in the filter and thus ensures the production of a predominantly liquid phase at the filter outlet.

The presence of the condensation coil 32 followed by the capillary 35 at the filter outlet creates a head loss appropriate for ensuring the heat exchange necessary for the recondensation of any gaseous fraction in the coil. The head loss created by the capillary tube—which opens onto the transfer line running to reservoir 1—in fact maintains in the coil 32 a vapor condensation pressure higher than atmospheric pressure, and thus a temperature higher than that of the liquid nitrogen in the bath. Heat exchange thus takes place with the liquid in the bath, which causes the condensation of any gaseous fraction produced at the filter outlet. Due to this arrangement, the outlet of the capillary 35 delivers almost exclusively liquid.

As for the coil 34 placed upstream from the filter, its installation is based on the fact that a warming of the cryogenic liquid (for example, liquid nitrogen) between the source 11 and the filtration module 5 can cause vaporization of a fraction of this liquid being fed to the filter. It is therefore useful to recondense this fraction before its entry into the sterilization filter. Recondensation along the coil 34 is thus effected in the same manner as described for the system 32 situated downstream from the filter, in this case simply by virtue of the head loss established across the filter 33 itself.

Figure 3:
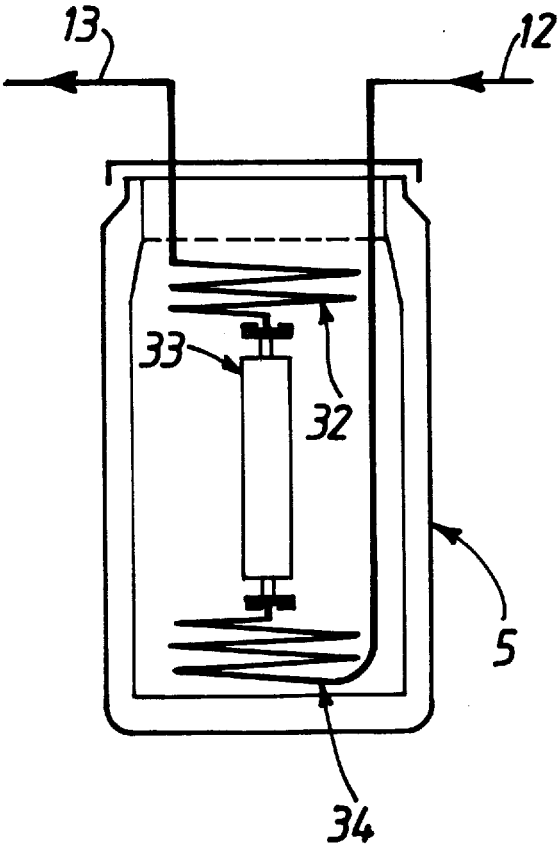
FIG. 3 is a schematic representation of another filtration module in conformity with the present invention.

FIG. 3 illustrates another configuration for filtration in a vertical geometry, wherein the cryogenic liquid successively encounters the coil 34, the filter 33, and a second coil 32 before exiting from the enclosure.

Figure 4:
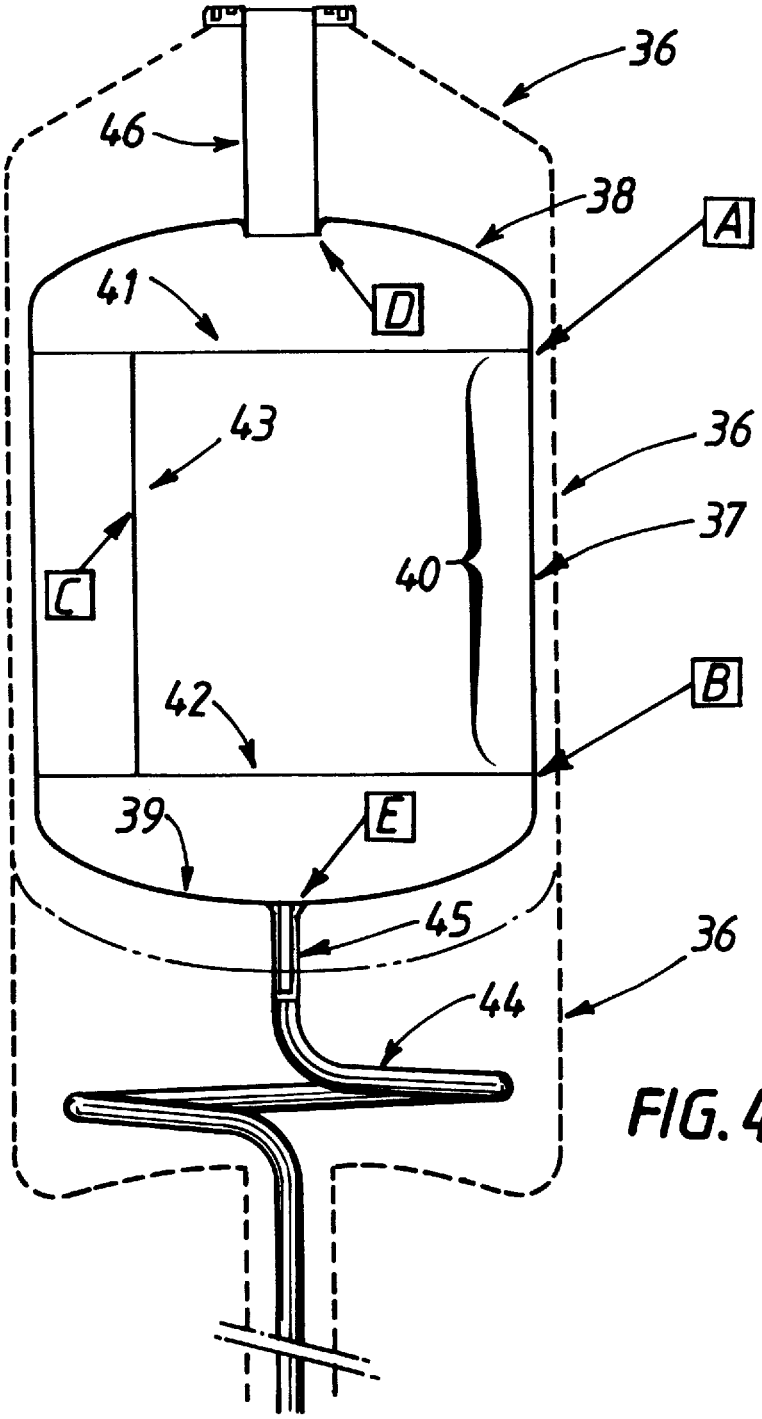
FIG. 4 is a schematic representation in section of a cryogenic reservoir used as part of an installation according to the invention.

FIG. 4 illustrates one embodiment of the cryogenic reservoir 1, comprising an outer wall 36 and an inner wall 37, wherein this inner wall includes three major parts, i.e., the barrel 40 and the two, upper and lower heads 38 and 39. Also present is a connecting piece (or neck) 46 between the inner wall and the outer wall and a take-off tube 45 that connects the head 39 of the inner wall to an evacuation coil (or loop) 44.

Reference numbers 41, 42, and 43 designate the weld points, respectively, between the upper head and the barrel, between the barrel and the lower head, and along the vertical joint constituting the closure of the cylindrical barrel.

The letters A, B, and C therefore designate the weld types used at joints 41, 42, and 43; the letter D designates the weld type used between the head 38 and the neck 46; and the letter E designates the weld type used at the point of connection between the head 39 and the take-off fitting 45.

Figure 5:
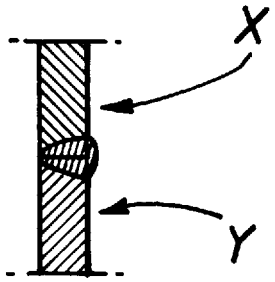
FIGS. 5 through 7 are illustrations of weld points in conformity with the invention on the inner Avail of the reservoir of FIG. 4.

FIG. 5 schematically depicts the "full-section" or "butt" weld used at A, B, C, and E wherein the (X, Y) pair of welded parts can represent the pairs (38, 40), (40, 39), or (40, 40) for the vertical joint 43.

Butt welds A/41 and B/42 can be produced, for example, using an automatic TIG technology under an argon-based gas mixture (current: 50 A; voltage: 10 V), with X2CrNil9-9 alloy 1.2 mm thick as filler metal and a peripheral gas blanket of nitrogen.

Again for illustration with regard to butt welding, the main conditions for obtaining weld C/43 would be, for example, automatic TIG technology under an argon-based gas mixture (current: 60 A; voltage: 13 V; welding speed: 40 cm/minute), with X2CrNiI9-9 alloy 1 mm thick as filler metal and a peripheral gas blanket of nitrogen.

Figure 6:
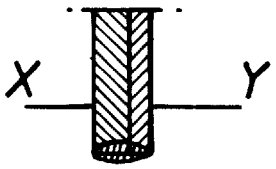

FIG. 6 illustrates in enlarged view the technique of "edge fusion" welding used for case D, wherein the (X, Y) pair of welded parts in this case represents pair (46, 38).

The conditions for obtaining the weld D between neck 46 and head 38 can be, for example, pulsed automatic TIG technology under an argon-based gas mixture (max. current: 20 A; min. current: 12 A; voltage: 11 V; welding speed: 15 cm/minute; electrode/workpiece distance: approximately 1 mm), without filler metal and without a peripheral gas blanket.

Figure 7:
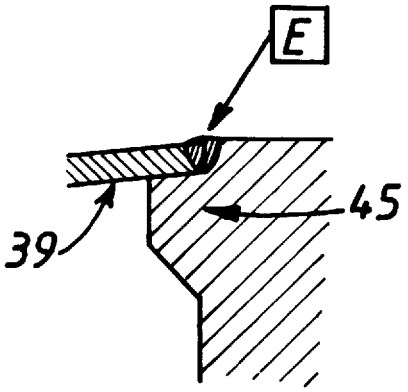

Finally, FIG. 7 illustrates, also in enlarged view, the use of the fullsection welding technique for case E to produce the joint between the head 39 and the take-off fitting 45.

An installation as described in connection with FIGS. 1 and 3 through 7 was used to supply a use station 47 past which bottles of fruit juice moved wherein each bottle received a dose of liquid nitrogen.

The bottles moved through the use station 47 at a speed which varied according to the particular scenario from 4,700 bottles/hour to 10,000 bottles/hour. In each of these scenarios the liquid nitrogen was delivered continuously via the control device 20.

One will understood from this that when this type of operation is selected some liquid nitrogen will be delivered at the use station 47 into the empty space between two successive bottles along the bottle conveying device.

After this installation had undergone a sterilization operation of the type described previously and which is detailed below, the installation was again supplied with liquid nitrogen from the source 11 and returned to production in order to supply the use station 47 and permit the withdrawal of liquid nitrogen samples for bacteriological analysis.

The capacity of reservoir 1 was on the order of 30 liters and the flow delivered to the use station was on the order of 100 L/h.

The sterilization operation included essentially the following stages:

evacuation of residual liquid nitrogen persisting in the installation by blowing with gaseous nitrogen from the panel 22 with the control valve 20 in the open position;

pumping out the installation via panels 15 and 7 (for a period on the order of 30 minutes to achieve a pressure in the neighborhood of 100 mbars);

steam sterilization at a temperature of 121° C. (measured at the lowest point of the installation via panel 15), for a period of approximately 15 minutes, via the panel 7 wherein isolation valve 21 was in the open position;

as previously mentioned, it is possible to program several pumping/sterilization cycles;

pumping out the installation under vacuum to bring about drying, via panel 15 (possibly supplemented by the intervention of panel 7), this phase lasting on the order of 45 minutes to 1 hour; and blowing filtered gaseous nitrogen into the installation via the panel 7 (the nitrogen thus travels through the filtration module 5).

Analyses were performed by standard techniques in the field of evaluating the microbial population in a contaminated fluid, and the results demonstrated in all cases the absence of microbes, and thus the fact that the filtration operation performed by the module 5, in combination with the use of a preliminary stage of steam sterilization of the entire installation, leads to the production and distribution of sterile nitrogen at the use station 47 as is desirable for the application under consideration.

Furthermore, tests performed by the applicant have in all cases demonstrated that the installation according to the invention permits a very effective control of the pressure reached in the interior of the container (which is secured by the pressure at the use station) whether the surface of the filled product is free or not (as is the case, for example, when the product filled in the container is foamy). Such a foam constitutes an exchanger for the liquid nitrogen which perturbs or at least modifies the vaporization phenomenon in the container and makes pressure control difficult.

All these tests have thus in particular demonstrated (due, for example, to the control means 20) an excellent control of the pressure level in the containers, even in these difficult cases of "foamy" products.

While the present invention has been described in connection with particular embodiments, it is not limited thereby, but on the contrary is susceptible to modifications and variants as may occur to a practitioner skilled in the art.

We claim:

1. A sterilizable installation for supplying at least one dose of a cryogenic liquid to a use station, comprising:

a source of a first cryogenic liquid;

a reservoir, suitable for temporary storage of the first cryogenic liquid, comprising a plural number of parts, and a plurality of welds connecting the parts, the welds connecting the parts such that total penetration with no lap between any two of the parts is achieved, and such that the reservoir is free, at connection points between the parts, from surface irregularities of the type permitting bacterial contamination, and the welds providing resistance to temperature fluctuations;

a first conduit connecting the source of the first cryogenic liquid and the reservoir;

means for withdrawing the first cryogenic liquid from the reservoir to supply a use station; and a second conduit connecting the reservoir and the withdrawing means.

2. The installation according to claim 1, wherein at least one of the welds is an edge fusion weld.

3. The installation according to claim 1 further comprising, between the source of the first cryogenic liquid and the reservoir, a filtration module, the filtration module including which comprises:

a bacteriological filter including an inlet adapted for supply by the source, an enclosure for containing a bath of a second cryogenic liquid, the filter being disposed in the enclosure such that the filter is adapted to be immersed in the bath of the second cryogenic liquid; and a recondensation coil disposed between the source of the first cryogenic liquid and the inlet of the filter such that the recondensation coil is adapted to be immersed in the bath of the second cryogenic liquid.

4. The installation according to claim 3, further comprising a second recondensation coil disposed on a downstream side of the filter from the recondensation coil such that the second recondensation coil is adapted to be immersed in the bath of the second cryogenic liquid.

5. The installation according to claim 4, further comprising means for creating a head loss, the means for creating the head loss being disposed on the downstream side of the filter such that the means for creating the head loss is adapted to be immersed in the bath of the second cryogenic liquid, wherein the second recondensation coil is disposed between the filter and the means for creating the head loss.

6. The installation according to claim 5, wherein the means for creating a head loss is a capillary tube.

7. The installation according to claim 3, wherein the source of the first cryogenic liquid and the source of the second cryogenic liquid are identical.

8. The installation according to claim 1, further comprising means for regulation of a level of the first cryogenic liquid in the reservoir, the level regulation means including (i) means of weighing the reservoir, and (ii) means for readjusting the level of the first cryogenic liquid as a function of a result of weighing.

9. The installation according to claim 1, further comprising the use station for dosing containers for food products with the first cryogenic liquid, and means for regulation of flow of the first cryogenic liquid delivered to the use station.

10. The installation according to claim 9, wherein the means for regulation of flow of the first cryogenic liquid delivers the first cryogenic liquid to the use station as a function of a rate of container movement at the use station.

11. The installation according to claim 9, wherein the means for regulation of flow of the first cryogenic liquid delivers the first cryogenic liquid to the use station as a function of a measure of pressure in a gaseous headspace of the reservoir.

12. The installation according to claim 1, wherein the reservoir comprises an outer wall and an inner wall , each of the outer wall and the inner wall including a plural number of parts, the inner wall of the reservoir defining an inner enclosure containing the first cryogenic liquid.

13. The installation according to claim 12, wherein the inner wall includes a barrel and two heads, and at least two of the welds are disposed between the barrel and each of the two heads, respectively.

14. The installation according to claim 12, wherein the reservoir includes, in an upper part thereof, a connection piece between the inner wall and the outer wall, the connection piece and the inner wall contacting each other, wherein at least one of the welds occurs at a point of contact between the connection piece and the inner wall.

15. The installation according to claim 13, wherein the second conduit contacts the inner wall and at least one of the welds is disposed at a point of contact between the second conduit and the inner wall.

16. The installation according to claim 1, wherein at least one of the welds is a full-section weld.

17. The installation according to claim 1, further comprising means for regulation of a level of the first cryogenic liquid in the reservoir.

18. The installation according to claim 17, wherein the level regulation means include (i) strain gages for registering strain resulting from the level of the first cryogenic liquid, and (ii) means for readjusting the level of the first cryogenic liquid as a function of values registered by the strain gages.

* * * * *